US009822540B2

(12) United States Patent
Baab

(10) Patent No.: US 9,822,540 B2
(45) Date of Patent: Nov. 21, 2017

(54) WATER CONSERVATION DEVICE FOR A SWIMMING POOL SKIMMER

(71) Applicant: Thomas William Baab, Bethlehem, PA (US)

(72) Inventor: Thomas William Baab, Bethlehem, PA (US)

( * ) Notice: Subject to any disclaimer, the term of this patent is extended or adjusted under 35 U.S.C. 154(b) by 259 days.

(21) Appl. No.: 14/673,877

(22) Filed: Mar. 31, 2015

(65) Prior Publication Data

US 2016/0289986 A1 Oct. 6, 2016

(51) Int. Cl.
*E04H 4/00* (2006.01)
*E04H 4/12* (2006.01)

(52) U.S. Cl.
CPC ..... *E04H 4/1272* (2013.01)

(58) Field of Classification Search
CPC ..... E04H 4/1272
USPC ..... 4/496, 507, 508, 510
See application file for complete search history.

(56) References Cited

U.S. PATENT DOCUMENTS

| | | | | |
|---|---|---|---|---|
| 3,144,340 | A * | 8/1964 | Powers | A21C 15/00 426/132 |
| 4,212,740 | A * | 7/1980 | Greene | E04H 4/1272 210/167.12 |
| 4,313,457 | A | 2/1982 | Cliff | |
| 2004/0099666 | A1* | 5/2004 | Ordiway | B65D 41/22 220/287 |
| 2013/0015111 | A1 | 1/2013 | Perham | |
| 2015/0059080 | A1* | 3/2015 | MacKinlay | B32B 37/06 4/506 |

* cited by examiner

*Primary Examiner* — Christine Skubinna
(74) *Attorney, Agent, or Firm* — Loza & Loza, LLP; Anthony J. Kefalos

(57) ABSTRACT

A water conservation device is disclosed. The water conservation device includes a membrane and an uninterrupted flange comprising a cross sectional cylindrical shape that is attached to an entire outer edge of the membrane. The membrane is configured to completely cover a top of a swimming pool skimmer access opening and further configured to accept an access lid of the swimming pool skimmer opening over the membrane wherein the access lid holds the water conservation device in place when the access lid is attached to the access opening by which the membrane acts to prevent water from expelling from the access lid.

11 Claims, 12 Drawing Sheets

WATER CONSERVATION DEVICE FOR A SWIMMING POOL SKIMMER

TECHNICAL FIELD

The present embodiments relate to generally to swimming pools and more specifically to swimming pool skimmers.

BACKGROUND

Swimming pools have become popular for both recreation and exercise. FIG. 1 is an illustration of a conventional above ground swimming pool 10. Outdoor swimming pools such as above ground swimming pools 10 naturally accumulate a large amount of debris. In order to mitigate the debris from fouling a circulating water system, many pools incorporate a swimming pool skimmer.

FIG. 2 is a perspective view of an example of a pool skimmer 20 of a conventional above ground swimming pool 10. The pool skimmer 20 has a large rectangular opening 28 with a weir door 24 that controls how water enters the pool skimmer 20. The pool skimmer 20 generally includes a basket (not shown) for catching some of the larger surface debris and a cylindrical discharge cylinder 26 at the bottom of it which connects to filter hoses of a circulating water system. The pool skimmer 20 also includes an access lid 22 that allows access to the basket for removal of debris.

FIG. 3 is an illustration of a pool skimmer 20 attached to an above ground swimming pool 10. A pool skimmer 20 in an above ground swimming pool 10 is attached to the wall 32 of the pool 10 by installing a faceplate (not shown) on the inside of the above ground swimming pool 10 and the pool skimmer 20 on the outside of the swimming pool 10.

FIG. 4 is a sectional view of the pool skimmer 20 illustrating water entering the pool skimmer 20. FIG. 4 illustrates a pool skimmer 20 in use in an in-ground swimming pool. Water enters the pool skimmer 20 while a pump (not shown) for circulating water is running and the water flows inward, the top of the weir door 24 pulls in a bit and forces more water to enter the pool skimmer 20 more from the surface 42 rather than from below the surface 44. The weir door 24 floats at the water level, causing a suction action to speed up the water flow and to pull in debris that accumulates at the surface 42. Greater flow from the surface 42 of the water translates to greater removal of surface, floating debris that would not be taken out as effectively without the weir door 24, thus, enhancing the debris removal process. This effect is desired in a swimming pool 10 and results in the skimming action of the pool skimmer 20 that removes floating debris (leaves, insects, pine needles, pollen, etc.).

FIG. 5 is a sectional view of the pool skimmer 20 that includes the skimmer basket 52 for catching debris. Because large surface debris received by pool skimmer 20 is caught in the skimmer basket 52, an access lid 22 which opens into an open chamber 56 to allow removal of the skimmer basket 52 for emptying the caught debris. The access lid 22 covers an access opening 54 allowing access to the open chamber 56 into which a quantity of the pool water enters the pool skimmer 20. Access opening 54 may be, for example, cylindrical in shape to complement a circular shaped access lid 22. The access lid 22 may include a central hole 58 by which the access lid 22 may be removed to access the skimmer basket 52. Access hole 58 has the purpose of enabling a user to insert a finger or tool into the access hole 58 to pull access lid 22 up for removal of the access lid 22 and allowing access to skimmer basket 52. Access lid 22 may be configured with the access hole 58 in alternative configurations other than that shown in FIG. 5 or access lid 22 may include more than one access hole 58.

FIG. 6 is an illustration of an example of activity in a conventional above ground swimming pool 10 causing turbulence on the surface of the above ground swimming pool 10.

Referring again to FIGS. 4 and 5, the pool skimmer 20 receives water primarily from the surface 42. Thus, the increased activity in the above ground pool 10 as shown in FIG. 6 results in more turbulent water entering the pool skimmer 20. Consequently, the turbulent water has the result of expelling water from the pool skimmer 20 through the access hole 58 of the access lid 22. This discharge of excess water can result in the wasteful loss of water and results in more frequent resupply of water. This situation can have a more amplified effect in regions where draughts are frequent and water loss more important to prevent. Such regions also generally experience a high population of swimming pools.

Thus, there is a need for a device to prevent the excess loss of water through pool skimmers during times when excessive turbulence leads to a higher loss of water.

SUMMARY

A water conservation device is disclosed. The water conservation device includes a membrane and an uninterrupted flange comprising a cross sectional cylindrical shape that is attached to an entire outer edge of the membrane. The membrane is configured to completely cover a top of a swimming pool skimmer access opening and further configured to accept an access lid of the swimming pool skimmer opening over the membrane wherein the access lid holds the water conservation device in place when the access lid is attached to the access opening by which the membrane acts to prevent water from expelling from the access lid.

DRAWINGS

The following figures set forth embodiments of the invention in which like reference numerals denote like parts. Embodiments of the invention are illustrated by way of example and not by way of limitation in the accompanying figures.

FIG. 7A is a perspective view of an exemplary flange attached to the water conservation device according to embodiments of the present invention;

FIG. 10A is a perspective view of an exemplary flange attached to the alternate shaped water conservation device according to embodiments of the present invention;

DETAILED DESCRIPTION

The description set forth below in connection with the appended drawings is intended as a description of various configurations and is not intended to represent the only configurations in which the concepts and features described herein may be practiced. The following description includes specific details for the purpose of providing a thorough understanding of various concepts. However, it will be apparent to those skilled in the art that these concepts may be practiced without these specific details. In some instances, well known, structures, techniques and components are shown in block diagram form to avoid obscuring the described concepts and features.

Figure 1:
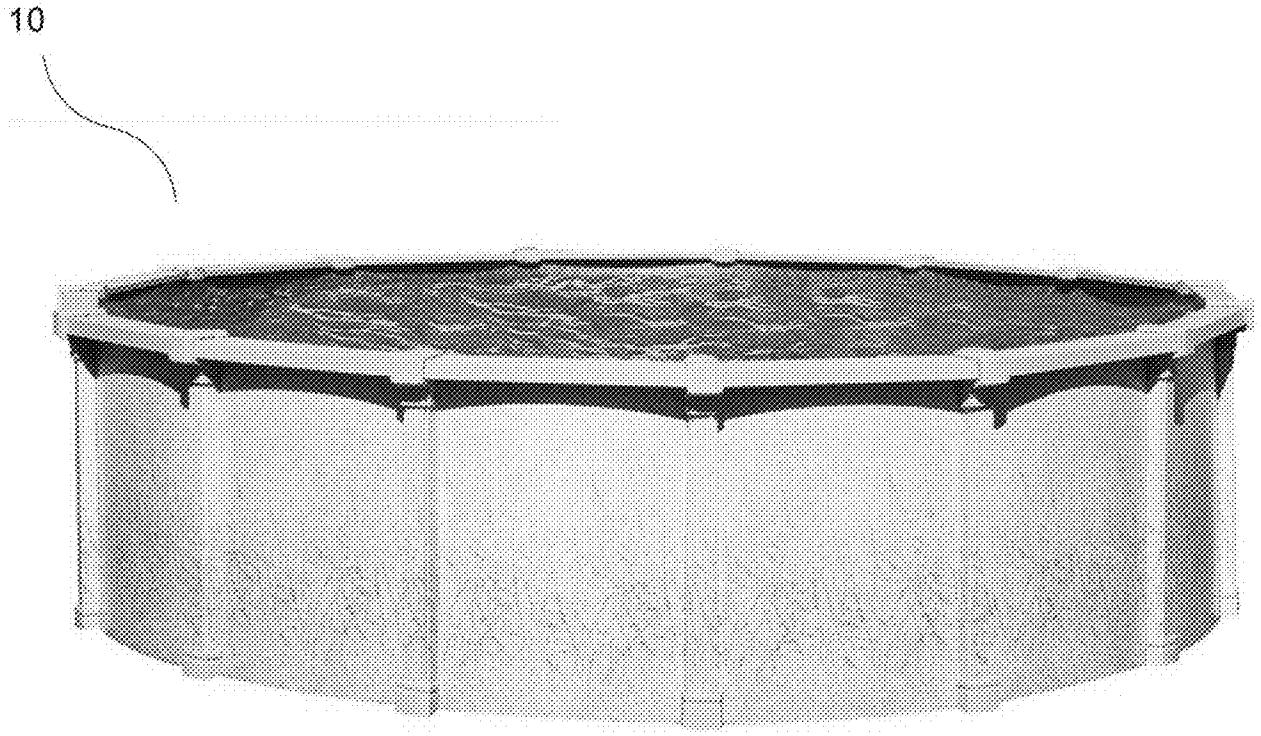
PRIOR ART FIGURE 1
FIG. 1 is an illustration of an example of a conventional above ground swimming pool.
Figure 2:
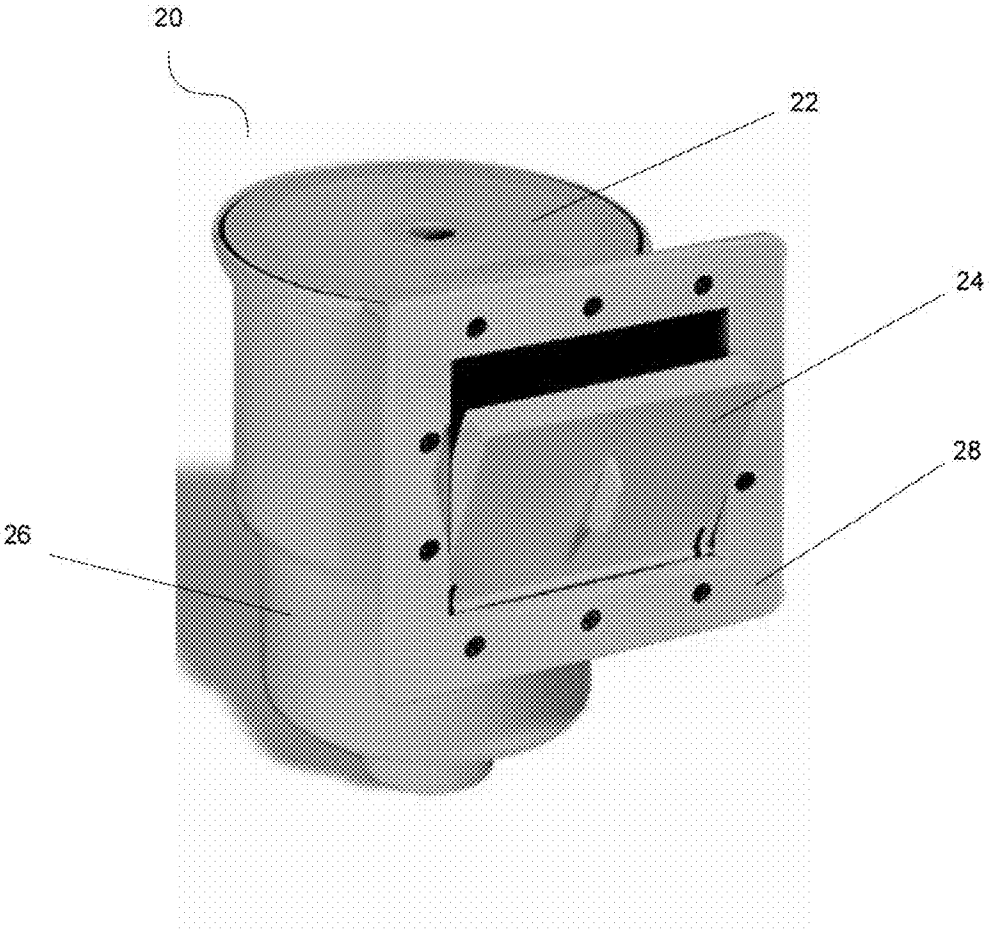
PRIOR ART Figure 2
FIG. 2 is a perspective view of an example of a pool skimmer of a conventional above ground swimming pool.
Figure 3:
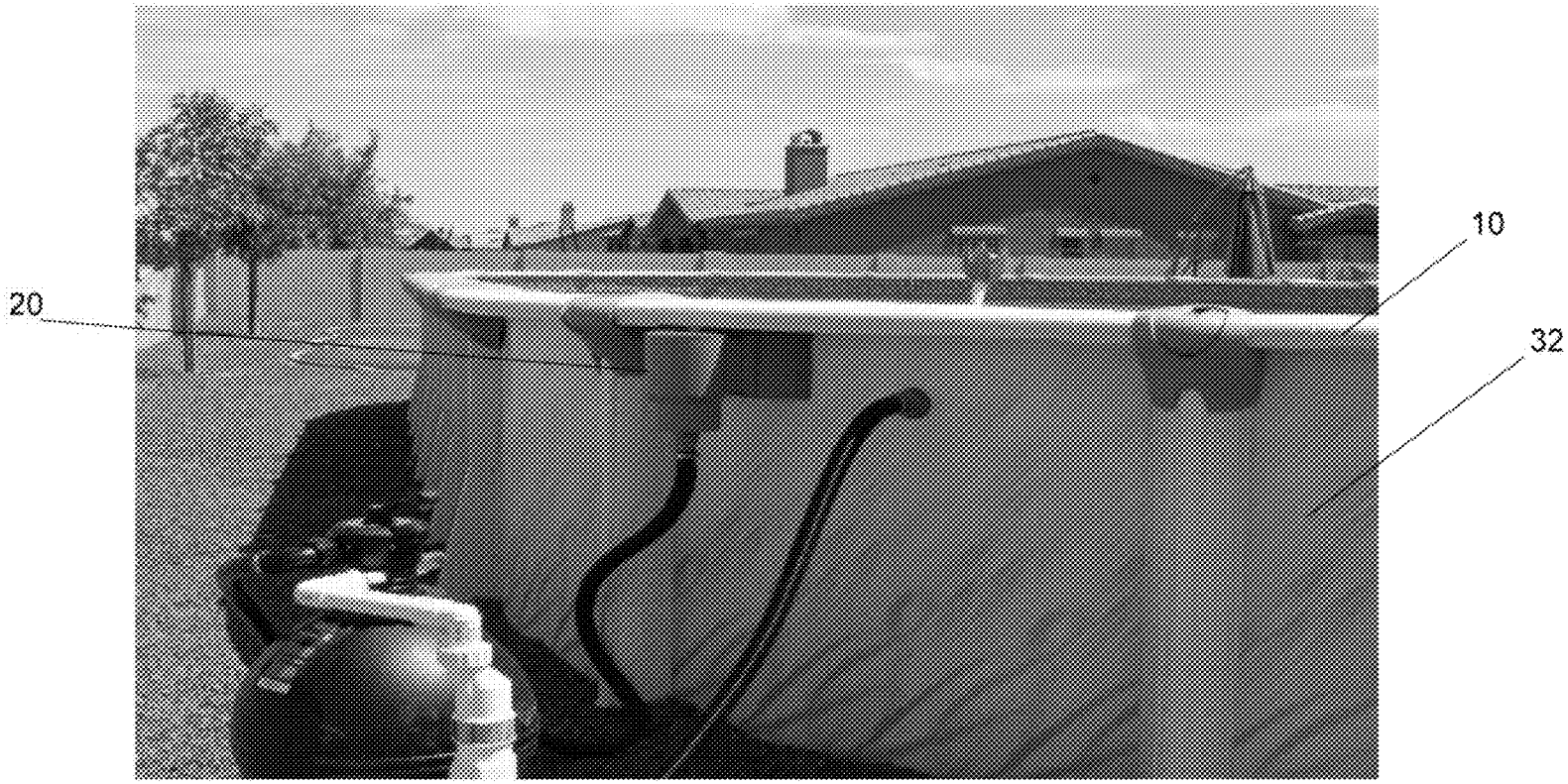
PRIOR ART Figure 3
FIG. 3 is an illustration of an example of the pool skimmer attached to the swimming pool.
Figure 4:
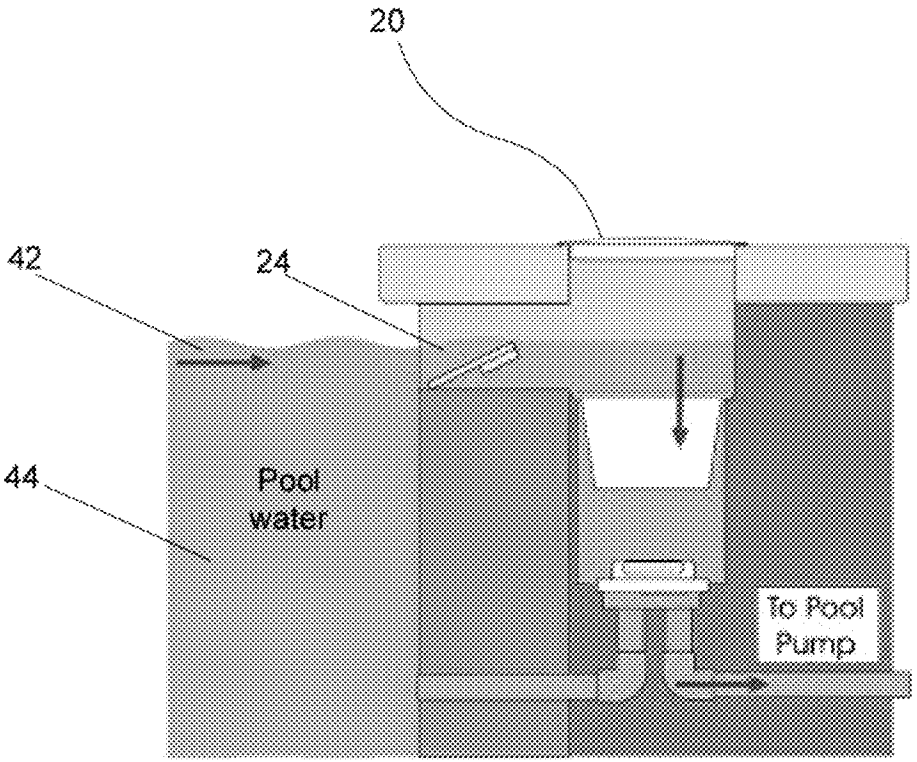
PRIOR ART FIGURE 4
FIG. 4 is a sectional view of the pool skimmer in an in-ground swimming pool showing water entering the pool skimmer.
Figure 5:
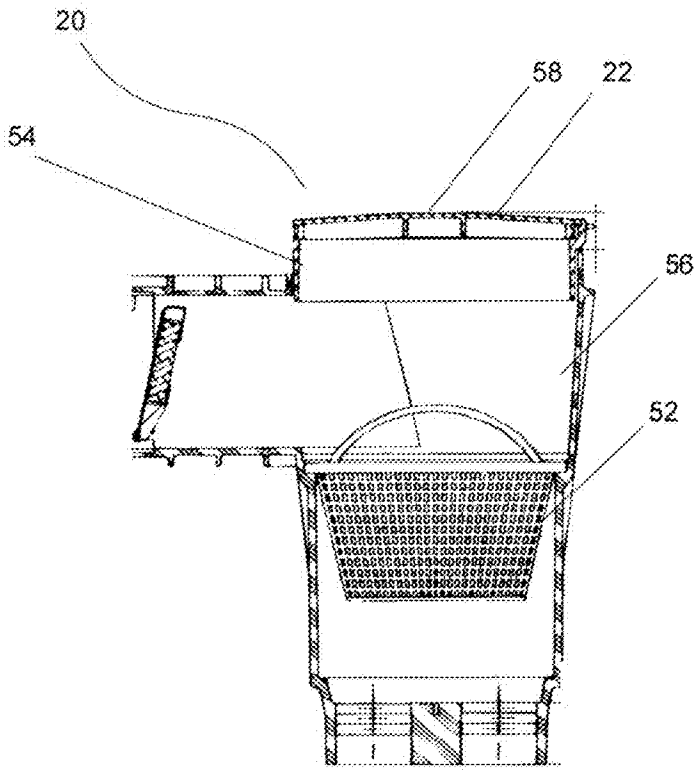
PRIOR ART FIGURE 5
FIG. 5 is a sectional view of the pool skimmer that includes the skimmer basket.
Figure 6:
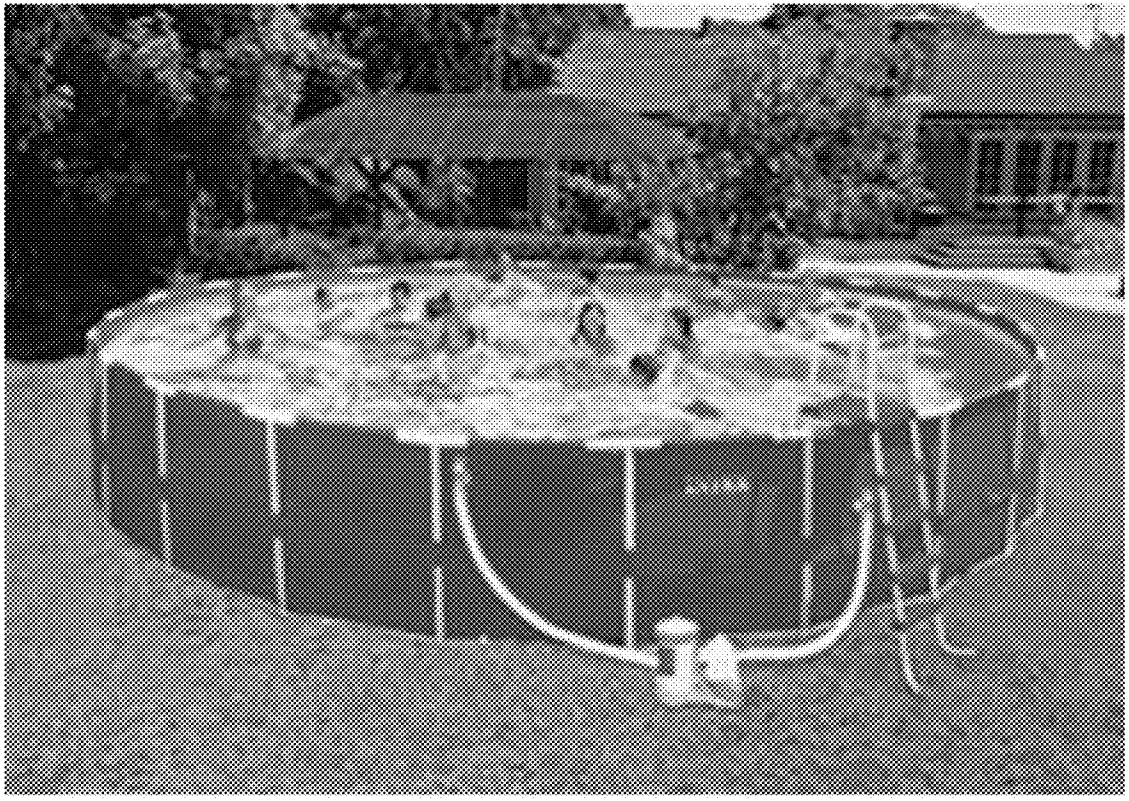
PRIOR ART Figure 6
FIG. 6 is an illustration of an example of activity in a conventional above ground pool.
Figure 7:
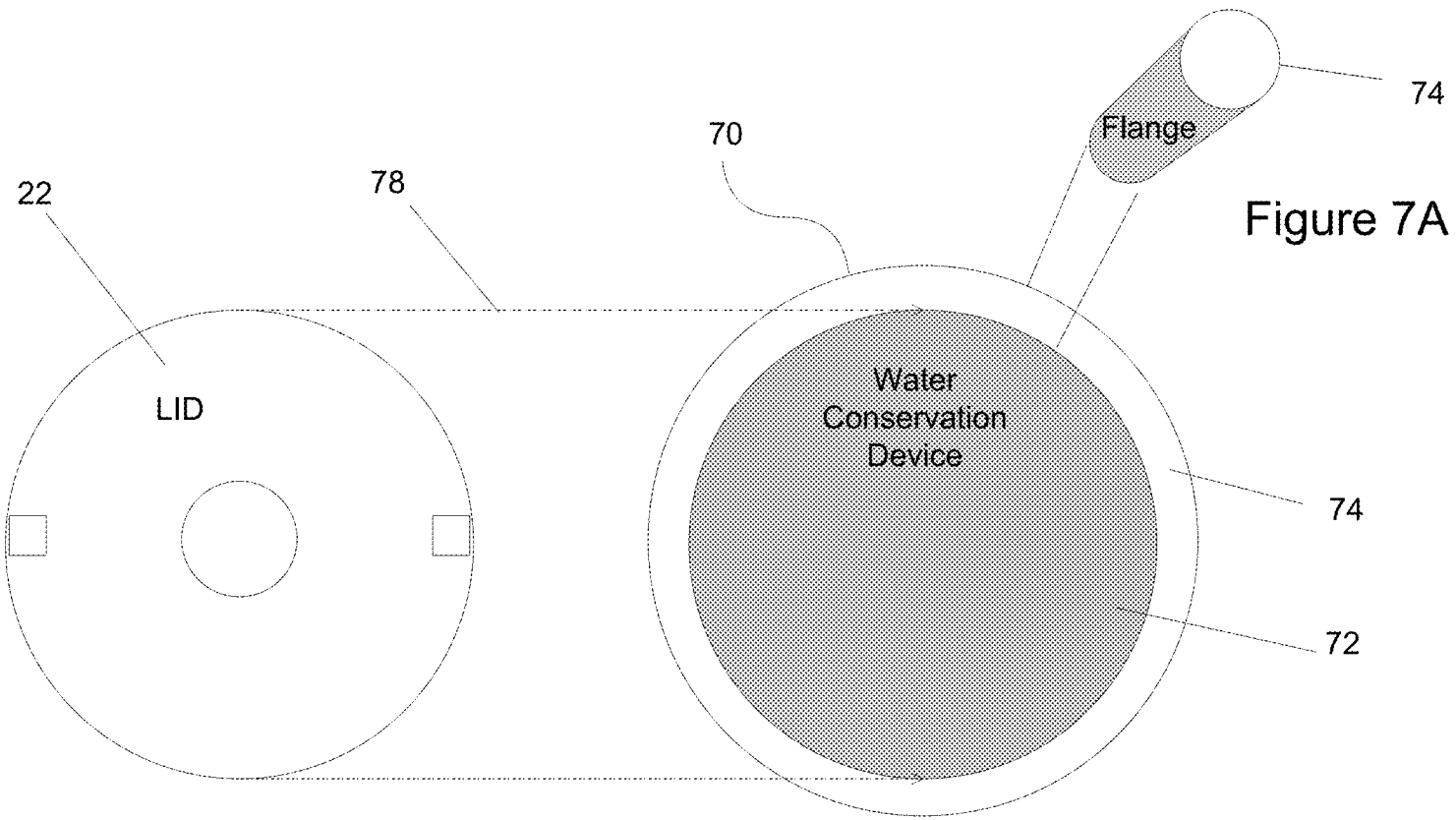
FIG. 7 is an exemplary perspective view of a water conservation device of an embodiment of the present invention.

FIG. 7 is an exemplary perspective view of a water conservation device 70 in an embodiment of the present invention. FIG. 7 is meant as an example only to illustrate an embodiment of the invention but is not intended as a limitation of the present subject matter or its implementation. The water conservation device 70 includes a flexible central membrane 72 which may be made, for example, of a flexible vinyl fabric material. The vinyl fabric material may be, for example, polyethylene (PE), polyvinyl chloride (PVC), polyvinyl acetate (PVac) or polyvinyl fluoride (PVF), for example. The vinyl material may be, for example, between 16 and 24 mils in thickness.

The water conservation device 70 further includes a flange 74 which is encompasses the entire outside edge uninterruptedly and which can be seen in an enlarged view in FIG. 7A. FIG. 7A is a perspective view of an exemplary flange 74 attached to the entire circumference of membrane 72 according to embodiments of the present invention. Flange 74 may be made for example of a durable slightly rigid plastic material. The plastic material may be made of, for example, polyethylene, PVC or nylon. The flange 74 is configured to maintain the membrane 72 in a consistent shape and provide for easy handling. The flange 74 may, for example, have a cross section that is cylindrical in shape where the cylinder may have a cross sectional diameter of ⅛-¾ inches. The flange 74 is attached to the membrane 72 by, for example, a water proof flexible vinyl cement. The water proof flexible vinyl cement may include, for example, Weld-On 66. In other embodiments, various other water proof flexible vinyl cements may be employed to attach the membrane 72 to the flange 74. In still other embodiments, the membrane 72 may be attached to the flange 74 through use of a heat application device such as a heat welding gun.

As shown in FIG. 7, the membrane 72 is circular in shape. However, the membrane 72 may be made in any shape that would provide for the water conservation of the present subject matter. As discussed in further detail below, the access lid 22 is placed over the water conservation device 70 as shown by dotted line 78.

Figure 8:
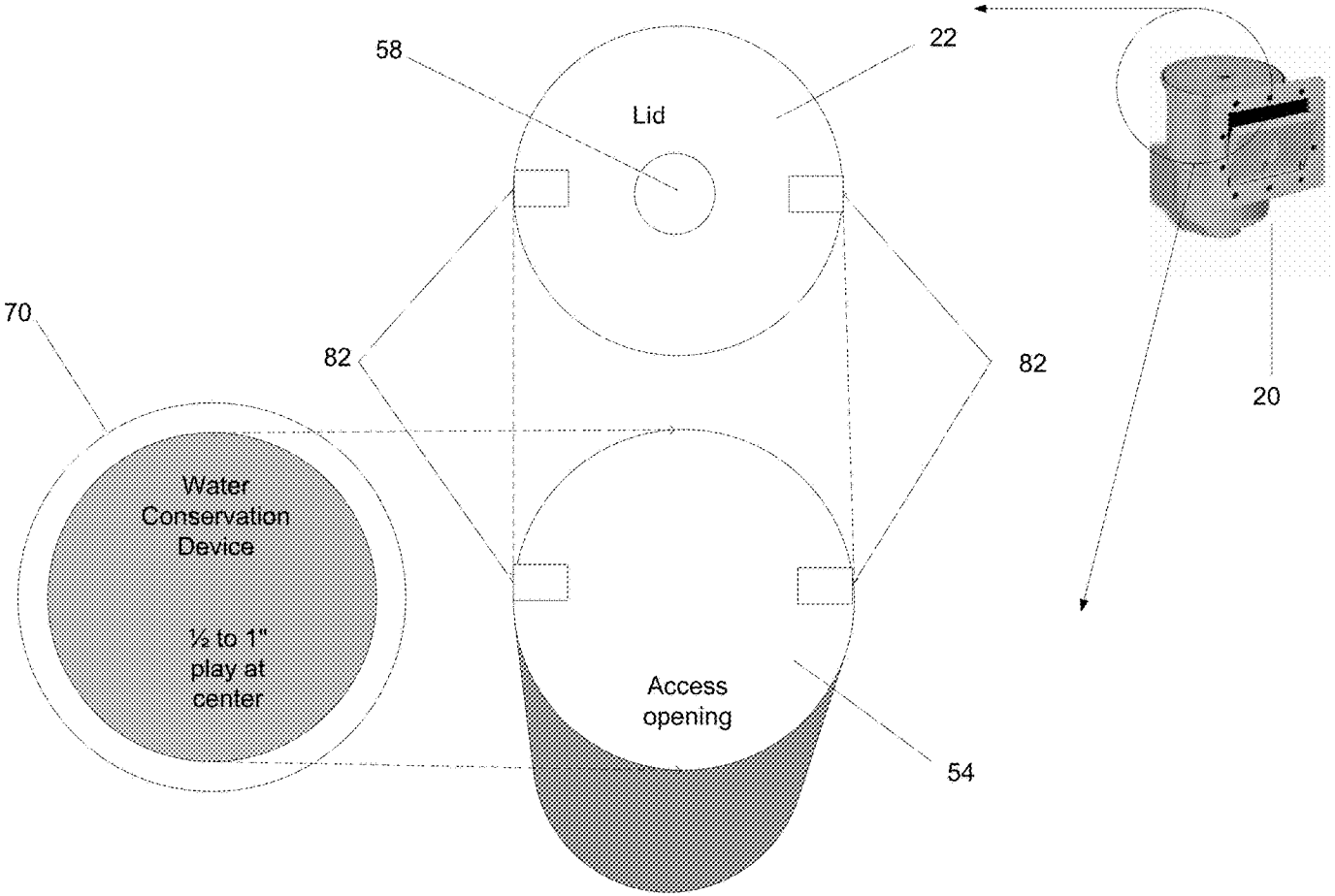
FIG. 8 is a cut-away perspective view of an exemplary placement of the water conservation device onto the pool skimmer according to the present embodiments.

FIG. 8 is a cut-away perspective view of an exemplary placement of the water conservation device 70 onto the access opening 54 of the pool skimmer 20 according to the present embodiments. Water conservation device 70 is placed over the access opening 54 where membrane 72 completely covers the access opening 54. The membrane 72 is made to completely encompass the diameter of the access opening 54 and further may be formed in a size that is between ½ and 1 inch larger than the diameter of the access lid 22 to allow "play" in the water conservation device 70 in the center of the water conservation device 70 and to permit easy placement under access lid 22. The "play" in the center of water conservation device 70 is sufficient to allow a user to place a finger or tool in the access hole 58 when necessary to remove the access lid 22 but secure enough so that there is little of the membrane 72 that protrudes from the access opening 54. A typical access lid 22 of a pool skimmer 20 may, for example, have a diameter of 10 inches. In this case, the membrane 72 may be between 10½ inches and 11 inches in diameter. Because the access hole 58 is required to open the pool skimmer 20 so that the skimmer basket 52 may be removed, the play allowed in water conservation device 70 maintains access to the access hole 58 and thus allows removal of access lid 22 for access to the skimmer basket 52 in the access chamber 56. Furthermore, water conservation device 70, due to its unique design may be easily removed when the activity in the swimming pool 10 causes little turbulence or when the swimming pool 10 is vacant. The play in the water conservation device 70 allows easy opening of the access lid 22 through the access hole 58 and easy handling by use of the attached flange 74 for removal.

The user may easily manipulate the placement of water conservation device 70 by handling the water conservation device 70 by the flange 74. Once placed over the access opening 56, the access lid 22 is placed over water conservation device 70. The Access lid 22 and the access opening 56 are assembled tongue-in-groove 82 fashion. Water conservation device 70 is placed such that the membrane 72 fits inside the tongue-in-groove 82 of the access lid 22 and the access opening 54 assembly. Again, the play is sufficient to allow a user to place a finger in the access hole 58 but secure enough so that there is little of membrane 72 that protrudes from the access cylinder 56 and the access lid 22.

The swimming pool skimmer 20 may include access opening 54 and access lid 22 that are shaped other than circular. In that case, water conservation device 70 would be configured to compliment the shape of access opening 54 and access lid 22 and membrane 72 would be configured to maintain the dimensions that are between ½ and 1 inch larger than dimension of the swimming pool skimmer access opening 54.

Figures 9, 9A, 9B:
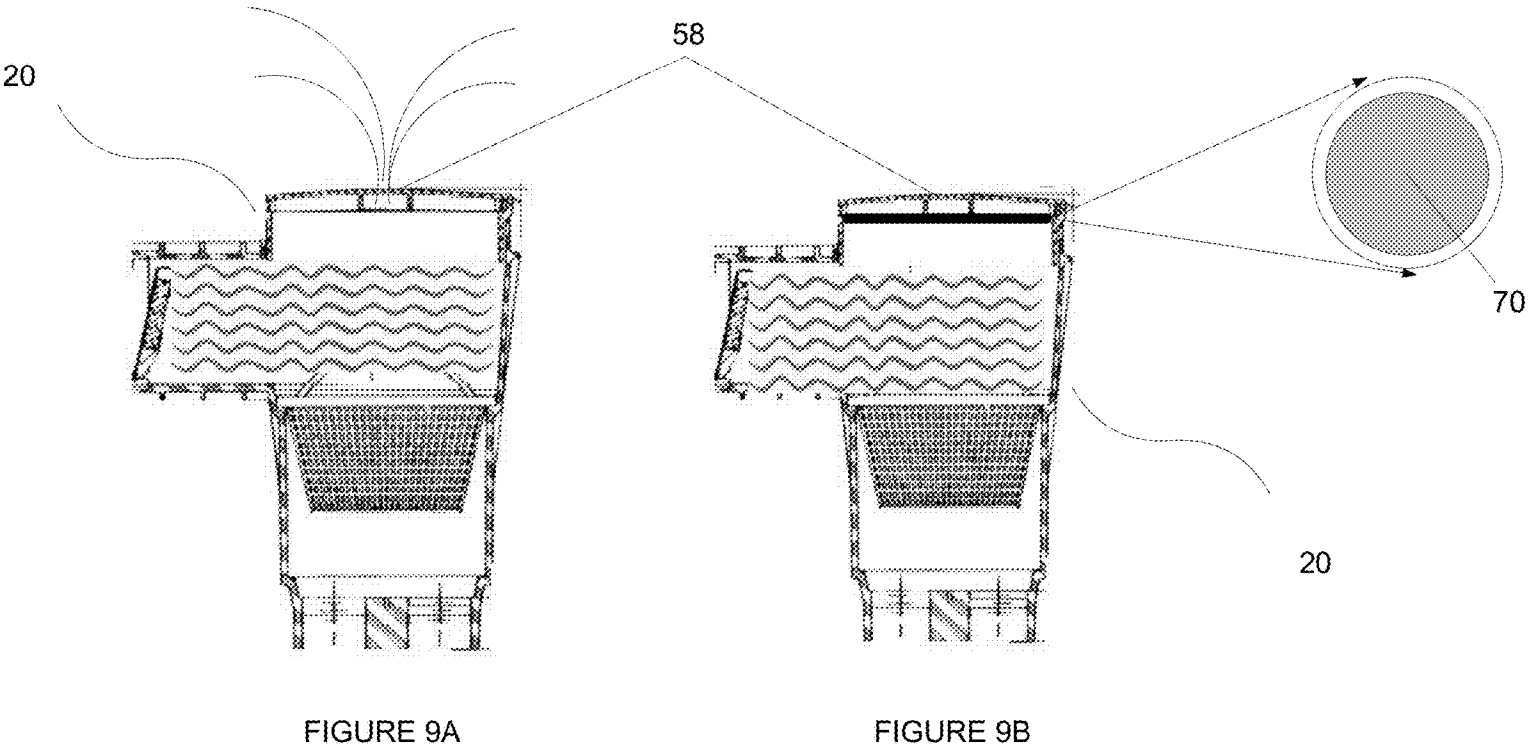
FIG. 9 is an exemplary operation of the water conservation device according to the present embodiments.
FIG. 9A is an exemplary scenario of the pool skimmer without the water conservation device.
FIG. 9B is an exemplary scenario of the pool skimmer including the water conservation device.

FIG. 9 is an exemplary water conservation device 70 in operation in a pool skimmer 20 of an above ground swimming pool 10. FIG. 9A illustrates a scenario in which turbulent activity in the swimming pool 10 is present and the water conservation device 70 is absent from the pool skimmer 20, water easily expels from access hole 58. Water is therefore lost to evaporation or seepage into the soil and must be replenished in swimming pool 10 resulting in needless water loss.

FIG. 9B illustrates the same scenario as FIG. 9A except that water conservation device 70 is present in pool skimmer 20. When placed as described above with respect to FIG. 8, the water conservation device 70 completely covers access hole 58, thus preventing water from being expelled from the access hole 58 when activity causing turbulent water conditions occur. Water in the scenario of FIG. 9B thus results in the prevention of water loss from the swimming pool 10.

Figure 10:
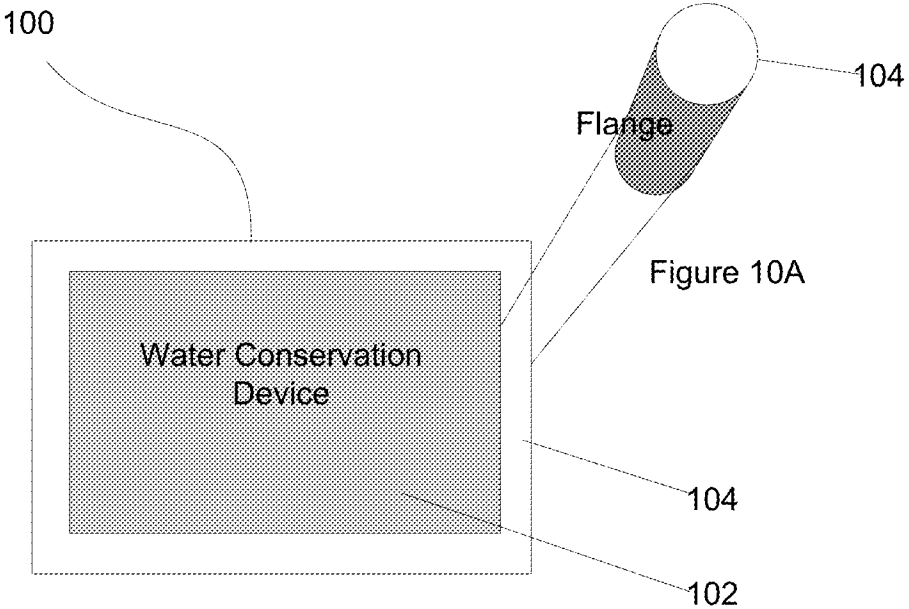
FIG. 10 is an exemplary perspective view of an alternate shape of a water conservation device of an embodiment of the present invention.

FIG. 10 is an exemplary perspective view of an alternate shape of a water conservation device of an embodiment of the present invention. As illustrated in FIG. 10, one possible alternate shape of water conservation device 100 is square. Similar to the circular water conservation device 70 shown in FIG. 7, the water conservation device 100 includes a flexible central membrane 102 that is square and which may similarly be made, for example, of a flexible vinyl fabric material. The vinyl material may be, for example, between 16 and 24 mils in thickness.

The water conservation device 100 further includes a flange 104 which is encompasses uninterruptedly the entire outside edge and which can be seen in an enlarged view in FIG. 10A. FIG. 10A is a perspective view of an exemplary flange 104 attached to the entire circumference of the membrane 102 according to embodiments of the present invention. Flange 104 may be made for example of a durable slightly rigid plastic material. The plastic material may be made of, for example, polyethylene, PVC or nylon. The flange 104 is configured to maintain the membrane 102 in a consistent shape and provide for easy handling. The flange 104 may, for example, have a cross section that is cylindrical in shape where the cylinder may have a cross sectional diameter of ⅛-¾ inches. The flange 104 is attached to the membrane 102 by, for example, a water proof flexible vinyl cement.

Figure 11:
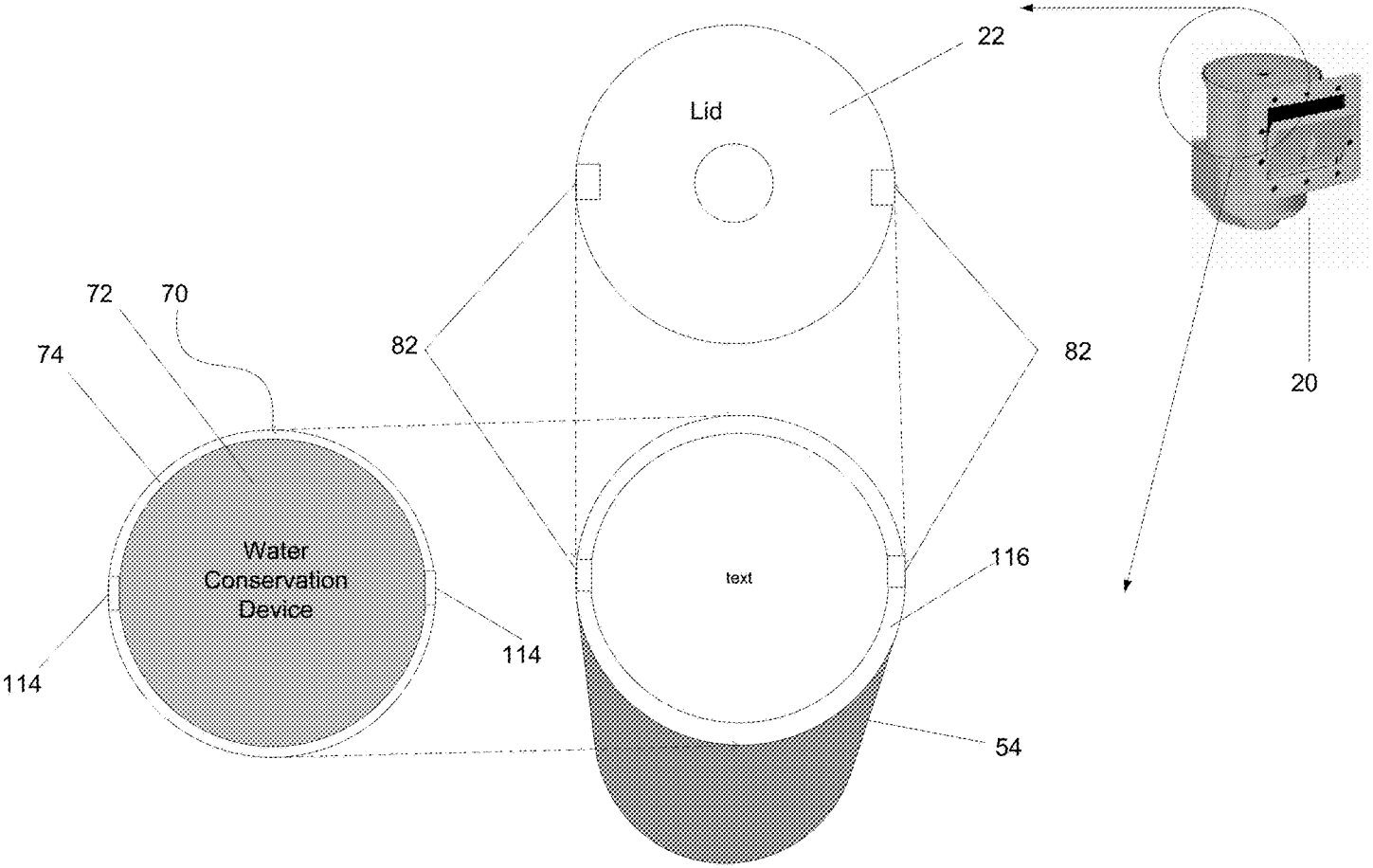
FIG. 11 is an exemplary cut-away perspective view of a water conservation device in an alternative embodiment of the present invention.

FIG. 11 is a cut-away perspective view of an exemplary alternative embodiment of the water conservation device 70 placed in a swimming pool skimmer 20. In the embodiment illustrated in FIG. 11, the access opening 54 and the lid 22 include a circumferential tongue-in-groove 116 on the circumference of the outer portion of the access opening 54 and the circumference of the outer portion of the lid 22 (not shown). In this embodiment, the water conservation device 70 is placed over the access opening 54 in which the flange 74 is configured with a circumferential dimension that corresponds to the circumference of the circumferential tongue-in-groove 116 of access opening 54 in order to fit precisely within the groove of circumferential tongue-in-groove 116. The membrane 72 continues to cover the access opening 54 completely encompassing the diameter of the access opening 54 and further may be formed in a size that is between ½ and 1 inch larger than the diameter of the access opening 54 to allow "play" in the water conservation device 70 in the center of the water conservation device 70 and to permit easy placement under access lid 22 as described above. In the embodiment of FIG. 11, the flange 74 includes a notch 114 corresponding to the notches of the tongue-in-groove 82 of the access lid 22 and access opening 54. The flange 74 is also configure to have a cross sectional diameter sufficient so that the flange 74 does not interfere with the circumferential tongue-in-groove 116 of access opening 54 and lid 22. The cross sectional diameter of the flange 74 may be, for example ¼ inches in diameter.

Figure 12:
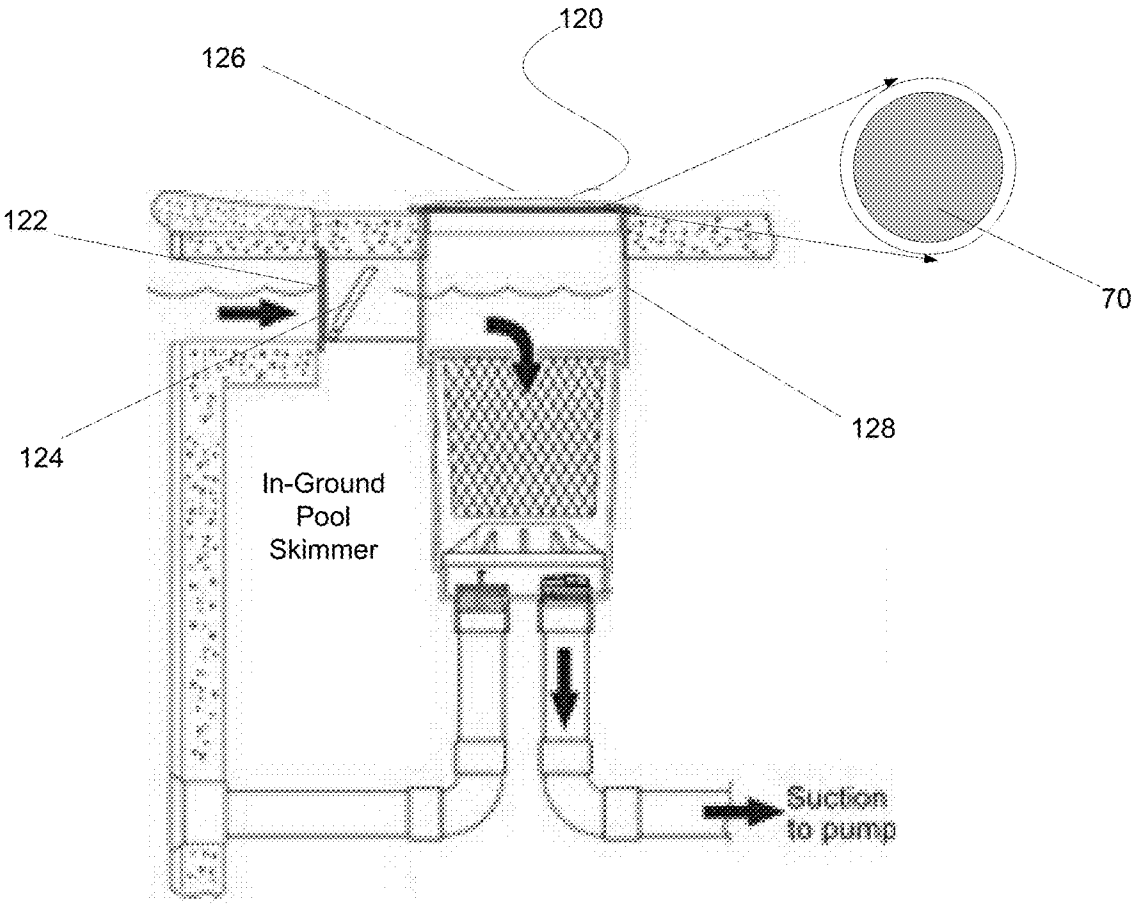
FIG. 12 is an exemplary water conservation device applied to a pool skimmer of an in-ground pool.

Although the above description has been made for above ground swimming pools, the described apparatus can be used for in-ground pools as well. FIG. 12 is an exemplary pool skimmer 120 for an in-ground pool. Pool skimmer 120 includes a large rectangular opening 122 with a weir door 124 that controls how water enters the pool skimmer 120. Pool skimmer 120 also includes an access lid 126 covering the access opening 128 of the pool skimmer 120. Similar to the description above (See, for example, FIGS. 8 and 11), water conservation device 70 is placed over the cylindrical opening 128 and secured by access lid 126. Thus, water is prevented from being expelled when activity causing turbulent water conditions occurs.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

I claim:

1. A pool skimmer device consisting of:

a membrane;

an uninterrupted flange consisting of a cross sectional cylindrical shape that is attached to an entire outer edge of the membrane; and the membrane completely covering a top of an access opening of a swimming pool skimmer and accepting an access lid of the swimming pool skimmer over the membrane wherein the access lid secures the membrane and thereby holds the pool skimmer device in place when the access lid is attached to the access opening, and wherein the membrane prevents turbulent water of a swimming pool from expelling from the access lid, thereby conserving water.

2. The pool skimmer device of claim 1, wherein the membrane is composed of a vinyl material.

3. The pool skimmer device of claim 2, wherein the vinyl material consists of polyethylene (PE), polyvinyl chloride (PVC), polyvinyl acetate (PVac) or polyvinyl fluoride (PVF).

4. The pool skimmer device of claim 2, wherein the membrane having a thickness of between 16 and 24 mils.

5. The water pool skimmer of claim 1, wherein the uninterrupted flange is composed of a plastic material.

6. The pool skimmer device of claim 5, where the plastic material is composed of polyethylene, PVC or nylon.

7. The pool skimmer device of claim 1, wherein the uninterrupted flange is attached to the membrane by a water proof glue.

8. The pool skimmer device of claim 7, wherein the uninterrupted flange is attached to the membrane by a heat application device.

9. The pool skimmer device of claim 1, wherein the membrane having a dimensional size of between ½ and 1 inch larger than the swimming pool skimmer access opening.

10. The pool skimmer device of claim 1, wherein the membrane consists of a dimensional size corresponding to a circumference of the swimming pool skimmer access opening to fit precisely within a groove of the circumferential opening.

11. The pool skimmer device of claim 1, wherein the uninterrupted flange having a cross sectional diameter of between ⅛ and ¾ inches.

* * * * *